United States Patent [19]

Ventura

[11] Patent Number: 4,987,728

[45] Date of Patent: Jan. 29, 1991

[54] FORM, FILL, AND SEAL APPARATUS

[75] Inventor: Francis P. Ventura, Upton, Mass.

[73] Assignee: T W Kutter Inc., Avon, Mass.

[21] Appl. No.: 414,356

[22] Filed: Sep. 29, 1989

Related U.S. Application Data

[63] Continuation of Ser. No. 189,025, May 2, 1988, abandoned.

[51] Int. Cl.[5] ..... B65B 41/16; B65B 47/00

[52] U.S. Cl. ..... 53/559; 53/389

[58] Field of Search ..... 53/453, 478, 389, 553, 53/555, 559

[56] References Cited

U.S. PATENT DOCUMENTS

| | | | |
|---|---|---|---|
| 3,555,768 | 1/1971 | Miller | 53/478 |
| 3,673,760 | 7/1972 | Canamero et al. | 53/433 |
| 3,849,969 | 11/1974 | Paules | 53/74 |
| 3,978,637 | 9/1976 | Mauriello | 53/450 |
| 4,034,536 | 7/1977 | Mahaffy et al. | 53/433 |
| 4,047,359 | 9/1977 | Gronebaum | 53/553 X |
| 4,048,782 | 9/1977 | Hamilton | 53/559 X |
| 4,064,676 | 12/1977 | King et al. | 53/77 |
| 4,329,830 | 5/1982 | Omori | 53/453 |
| 4,592,191 | 6/1986 | Simington | 53/509 |
| 4,633,651 | 1/1987 | Edmunds | 53/435 |
| 4,819,406 | 4/1989 | Redmond | 53/559 X |

*Primary Examiner*—Robert L. Spruill
*Assistant Examiner*—Linda B. Johnson
*Attorney, Agent, or Firm*—Fish & Richardson

[57] ABSTRACT

Form and fill packaging apparatus including a vacuum thermoformer where a first plastic web is formed to provide receptacles for receiving articles, a filling station where articles are placed in the formed receptacles, a sealing station where a second web is placed over the filled receptacles and sealed to portions of the web around the receptacles, first web drive means for driving the first web through the thermoformer, filling station and sealing station, and a feed mechanism for positively feeding the second web to the first web at the sealing station synchronously with driving of the first web.

20 Claims, 2 Drawing Sheets

FORM, FILL, AND SEAL APPARATUS

This application is a continuation of application Ser. No. 07/189,025, filed May 2, 1988 now abandoned.

BACKGROUND OF THE INVENTION

The invention relates to forming, filling, and sealing plastic packaging.

In form, fill, and seal apparatus, a bottom web of plastic is advanced through a vacuum thermoformer (where the plastic web is formed to provide receptacles for receiving articles), a filling station (where articles are placed in the formed receptacles), a sealing station (where a top web made of plastic, paper, or other sheet material is placed over the filled receptacles and sealed to portions of the bottom web around the receptacles to provide covers), and a cutter (where the sealed top and bottom webs are cut at portions between receptacles into separate packages).

Normally the bottom web of plastic is driven through the thermoformer, filling station, and sealing station via continuous loop drive chains underneath the two side edges of the web. The top web is pulled by virtue of being sealed to the bottom web at the sealing station. The movement of the bottom and top webs typically is intermittent (often referred to as indexed), as the thermoform and fill operations are performed when the web is stationary. During each movement of the webs between the simultaneous form and fill operations at respective stations, both webs are of course accelerated and decelerated. The upper web passes from its supply roll around a weighted dancer, which assists in smoothing out stresses in the upper web. The dancer is lifted as the web is first drawn, and a brake mechanism prevents rotation of the supply roll except when the dancer has been raised to a particular position. Depending upon the tack between upper and lower webs at the seal and the amount of travel of each movement, the speed of the webs during indexing may have to be limited to avoid damage to the seal. E.g. weld seals are strong, are formed quickly, and can permit relatively fast pulling of the upper web. Seals for removable covers are weaker and may be destroyed if the lower web is moved too fast. Seals that take a long time to form and seals involving cover webs made of certain (e.g., fragile) materials may also be destroyed if they are moved too fast.

SUMMARY OF THE INVENTION

In general the invention features improving form and fill packaging apparatus in which a first web of plastic is advanced through a thermoformer at which receptacles are formed in the first web, a filling station at which the receptacles are filled with articles, and a sealing station at which the receptacles are covered by a second web that is sealed to the first web at portions surrounding the receptacles. The improvement involves providing a feed mechanism for positively feeding the second web to the first web at the sealing station synchronously with advancing of the first web. This provides less stress on the seal between the two webs at the sealing station during advancement, promoting seal integrity and permitting higher speeds for weak seals (and thus higher throughput of the packaging apparatus) without deterioration of the seals.

In preferred embodiments the feed mechanism includes a drive roller located in close proximity to the sealing station; the drive roller is driven by the drive mechanism (e.g., drive chain) for the first web; there is an idle roller that engages the second web with the drive roller; the drive roller is pushed into position against the idle roller during advancement of the webs; the drive roller has drive portions that have a larger diameter than adjacent portions; the drive portions are resilient disks that provide good grip; the drive roller overdrives the second web slightly with respect to the first web to guarantee that the second web is not underdriven; there are a weighted dancer and idle rollers around which the second web travels between a supply roll and the drive roller; and the feed mechanism includes a sprocket that is driven by the first web drive chain, and further sprockets and gears that are mounted on a pivotal lever arm.

Other advantages and features of the invention will be apparent from the following description of the preferred embodiment thereof and from the claims.

DESCRIPTION OF THE PREFERRED EMBODIMENT

The preferred embodiment will now be described.

DRAWINGS

STRUCTURE

Figure 1:
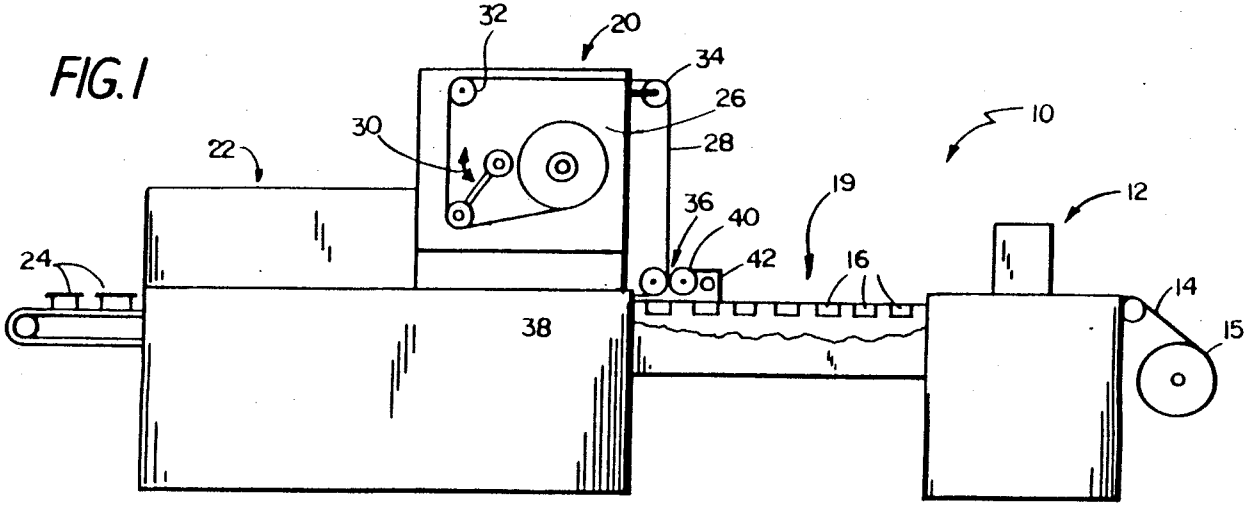
FIG. 1 is a diagrammatic elevation of form, fill, and seal packaging apparatus according to the invention.

Referring to FIG. 1, there is shown form and fill packaging apparatus 10. Form and fill apparatus 10 includes vacuum thermoformer 12, which forms first web of plastic 14 advanced from supply roll 15 through it so as to provide formed receptacles 16 for receiving articles to be packaged at downstream filling station 19. Sealing station 20 provides a cover over filled receptacles 16, and cutter 22 cuts the formed, filled, and sealed web into individual packaged products 24.

Figure 2:
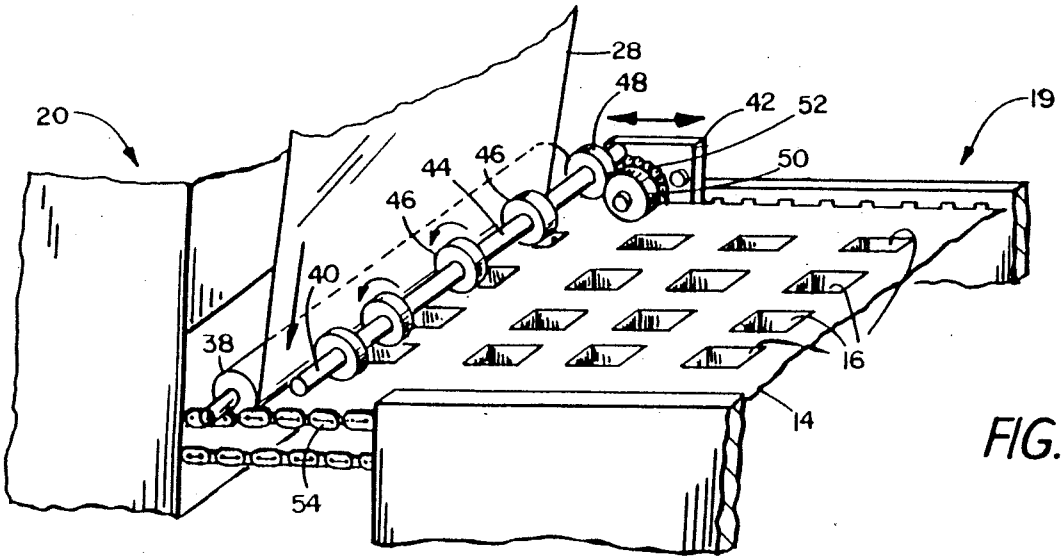
FIG. 2 is a partial diagrammatic perspective view showing a web feed mechanism of the FIG. 1 apparatus between a filling station and a sealing station.

Referring to FIGs. 1 and 2, sealing station 20 includes supply roll 26 of second upper web 28, which is sealed over the tops of the filled, formed receptacles 16 to provide covers for them. Web 28 passes from roller 26 around weighted dancer 30 (which is pivotal about its upper end) and idle rollers 32, 34 before passing to positive feeding mechanism 36, which is used to feed web 28 to web 14 synchronously with advancing of web 14. Feed mechanism 36 includes idle roller 38 and drive roller 40 mounted on lever arms 42 (only one of which is shown in the figures). Drive roll 40 includes drive shaft 44 and rubber drive disks 46, which grip web 28 between them and idle roller 38 when engaged. Drive shaft 44 has gear 48 that mates with gear 50, which is in turn driven by sprocket 52. Both gear 50 and sprocket 52 are rotatably mounted by a common shaft on lever arm 42. Web 14 is driven by continuous loop drive chains 54, one on each side of web 14, which carry spring-loaded mushroom clips 56 to engage the edges of web 14.

Figure 4:
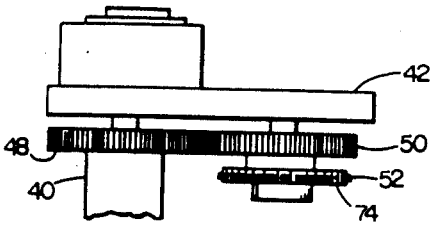
FIG. 4 is a partial plan view of the FIG. 3 components.
Figure 3:
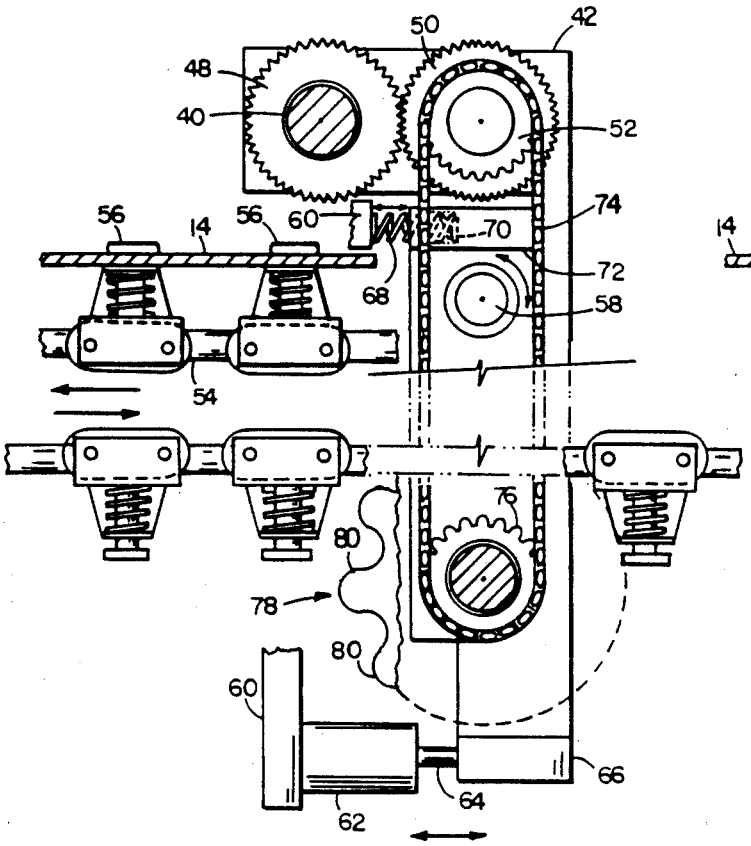
FIG. 3 is an elevation, partially broken away and in section, showing components of the FIG. 2 feed mechanism.
Figure 5:
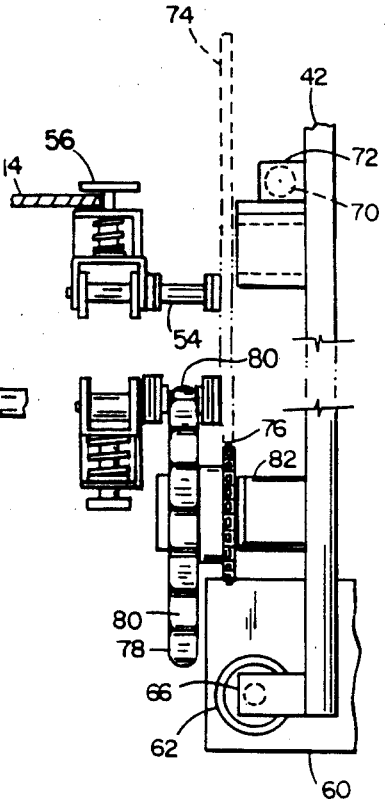
FIG. 5 is a partial side elevation, partially broken away and in section, of the FIG. 3 components.

Referring to FIGS. 3–5, it is seen that lever arm 42 is mounted for pivoting about shaft 58, which is mounted on a bracket 60, only two small portions of which are shown on FIG. 3. Solenoid 62 is mounted on a lower part of bracket 60 and includes plunger 64, which contacts lower block 66 of lever arm 42 and is operable to move lever arm 42 counterclockwise. Spring 68 is mounted in recess 70 of block 72 of lever arm 42 and pushes against an upper portion of bracket 60 so as to bias lever arm 42 clockwise. Chain 74 engages upper sprocket 52 and lower sprocket 76, which is mounted for rotation on lever arm 42 with large sprocket 78 that has teeth 80 engaging drive chain 54 for web 14. Sprockets 76, 78 are mounted by bearing and shaft component 82 supported on lever arm 42. In FIG. 3 only a small number of teeth 80 of sprocket 78 are shown. It is seen that mushroom clips 56 include spring-loaded cap members that engage the edge of web 14 between them and facing horizontal members.

OPERATION

In operation, web 14 from supply roll 15 is formed at thermoformer 12 to provide formed receptacles 16. At filling station 19, articles (not shown) are placed into formed receptacles 16 via a loading mechanism (not shown). The filling of receptacles 16 at filling station 19 and the thermoforming at thermoformer 12 occur on portions of web 14 when the web is stationary between indexing steps during which new portions of the web are moved into the respective stations.

At sealing station 20, the formed and filled receptacles 16 are covered with upper web 28. Upper web 28 is positively fed by feed mechanism 36 synchronously with the driving of web 14. Referring to FIG. 3, as drive chain 54 for lower web 14 moves, it engages teeth 80 of sprocket 78 and causes sprocket 78 to rotate. This in turn causes the adjacent smaller sprocket 76 to rotate and to advance chain 74, in turn causing rotation of upper sprocket 52, gear 50, and gear 48 on drive shaft 44. Feed mechanism 36 is engaged when chain 54 is moving by solenoid 62, which pushes lever arm 42 counterclockwise as shown in FIG. 3, in turn pushing shaft 44 and drive disks 46 up against web 28, which is supported on idle roller 38. Web 28 is thus fed as drive shaft 44 is rotated. The ratios of the gears and sprockets are such that upper web 28 is designed to be overfed slightly (about 1%) with respect to lower web 14 to guarantee that web 28 is not underfed with respect to web 14; owing to tolerances, an exact matching of the feeding of the two webs is unlikely, and small overfeeding of the upper web is much more easily accommodated than small underfeeding. Dancer 30 and idle rolls 32, 34 provide a slight amount of tension during feeding in order to properly align the positioning of web 28. After the indexing operation, plunger 64 is retracted, and lever 42 is biased clockwise by spring 68 to disengage rollers 46 from web 28; this permits the tension in web 28 to be adjusted.

By using feed mechanism 36, apparatus 10 can be operated at higher speeds than would be permitted otherwise without a deterioration in seal strength for removable cover seals and other weak seals, e.g., seals that take a long time to form and seals involving fragile cover webs.

OTHER EMBODIMENTS

Other embodiments of the invention are within the scope of the following claims.

What is claimed is:

1. Form and fill packaging apparatus comprising a thermoformer where a first plastic web is formed to provide formed receptacles for receiving articles, a filling station where articles are placed in the formed receptacles, a sealing station where a second web is placed over the filled receptacles and sealed to portions of the web around the receptacles, first web drive means for advancing said first web through said thermoformer, filling station and sealing station, in an intermittent manner, and a feed mechanism that positively feeds said second web to said first web at said sealing station synchronously with the advancing of said first web, said feed mechanism comprising a drive roller and an idle roller that engage said second web, said feed mechanism also comprising an engagement mechanism operable to push said drive roller into position against said idle roller during movement of the first web, and a disengagement mechanism operable to disengage said drive roller when said first web is not moving.

2. The apparatus of claim 1 wherein said idle roller has a continuous surface.

3. The apparatus of claim 2 wherein said drive roller has drive portions having larger diameter than adjacent portions of said drive roller.

4. Form and fill packaging apparatus comprising a thermoformer where a first plastic web is formed to provide formed receptacles for receiving articles, a filling station where articles are placed in the formed receptacles, a sealing station where a second web is placed over the filled receptacles and sealed to portions of the web around the receptacles, first web drive means for advancing said first web through said thermoformer, filling station and sealing station, and a feed mechanism that positively feeds said second web to said first web at said sealing station synchronously with the advancing of said first web, said feed mechanism including one or more rotating drive members that have radial dimensions sized so as to cause overfeeding of said second web slightly with respect to said first web.

5. The apparatus of claim 4 wherein said drive member is connected to be driven by said first web drive means.

6. The apparatus of claim 5 wherein said first web drive means comprises a drive chain that moves at the same speed as said first web.

7. The apparatus of claim 6 wherein said feed mechanism comprises a first sprocket that engages said drive chain.

8. The apparatus of claim 7 wherein said feed mechanism comprises a second sprocket that is driven by said first sprocket, a feed chain that is driven by said second sprocket, and a third sprocket that is driven by said feed chain and drives said drive member.

9. The apparatus of claim 8 wherein said feed mechanism comprises a first gear driven by said third sprocket and a second gear that is driven by said first gear and that drives said drive member.

10. The apparatus of claim 9 wherein said sprockets, gears, and drive member are supported by a pivotal lever arm that pivots into position against said second web.

11. The apparatus of claim 4 further comprising an idle roller that engages said second web with said drive member.

12. The apparatus of claim 4 wherein there is an engagement mechanism operable to activate said drive member to drive said second web.

13. The apparatus of claim 12 wherein there is an idle roller that engages said second web with said drive member, and said engagement mechanism is operable to push said drive member into position against said idle roller.

14. The apparatus of claim 12 further comprising a rotatable supply roll providing a source of said second web.

15. The apparatus of claim 14 further comprising idle rolls around which said second web travels between said supply roll and said drive member.

16. The apparatus of claim 14 wherein said supply roll has a brake preventing rotation of said supply roll, and further comprising a weighted dancer operable to release said brake.

17. The apparatus of claim 4 wherein said drive means drives said first web intermittently.

18. The apparatus of claim 4 wherein said rotating drive members include sprockets.

19. The apparatus of claim 18 wherein said rotating drive members include gears.

20. The apparatus of claim 4 wherein said rotating drive members include a drive roller that engages said second web.

* * * * *